US008153055B2

(12) United States Patent
Nakamura et al.

(10) Patent No.: US 8,153,055 B2
(45) Date of Patent: Apr. 10, 2012

(54) FERRITIC STAINLESS STEEL WITH EXCELLENT HEAT RESISTANCE

(75) Inventors: Tetsuyuki Nakamura, Tokyo (JP); Hiroki Ota, Tokyo (JP); Yasushi Kato, Tokyo (JP); Takumi Ujiro, Tokyo (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 13/254,956

(22) PCT Filed: Jul. 5, 2010

(86) PCT No.: PCT/JP2010/061733

§ 371 (c)(1), (2), (4) Date: Sep. 6, 2011

(87) PCT Pub. No.: WO2011/024568

PCT Pub. Date: Mar. 3, 2011

(65) Prior Publication Data

US 2012/0020827 A1 Jan. 26, 2012

(30) Foreign Application Priority Data

| | | |
|---|---|---|
| Aug. 31, 2009 | (JP) | 2009-199415 |
| Dec. 3, 2009 | (JP) | PCT/JP2009/070632 |
| Dec. 9, 2009 | (JP) | 2009-279234 |
| Jun. 30, 2010 | (JP) | 2010-148604 |

(51) Int. Cl.

| | |
|---|---|
| ***C22C 38/20*** | (2006.01) |
| ***C22C 38/26*** | (2006.01) |
| ***C22C 38/28*** | (2006.01) |

(52) U.S. Cl. ..... 420/60; 420/62; 420/70

(58) Field of Classification Search ..... 420/60, 420/62, 70; 148/325

See application file for complete search history.

(56) References Cited

U.S. PATENT DOCUMENTS 4,331,474 A * 5/1982 Espy ..... 420/57

FOREIGN PATENT DOCUMENTS

| | | | |
|---|---|---|---|
| JP | 2000-297355 | A | 10/2000 |
| JP | 2001-316773 | A | 11/2001 |
| JP | 2004-018921 | A | 1/2004 |
| JP | 2004-307918 | A | 11/2004 |
| JP | 2005-187857 | A | 7/2005 |
| JP | 2006-117985 | A | 5/2006 |
| JP | 2008-285693 | A | 11/2008 |
| WO | 03/004714 | A1 | 1/2003 |
| WO | 2009/110640 | A1 | 9/2009 |

* cited by examiner

*Primary Examiner* — Deborah Yee

(74) *Attorney, Agent, or Firm* — DLA Piper LLP (US)

(57) ABSTRACT

A ferritic stainless steel contains no expensive elements such as Mo and W, is free from the oxidation resistance loss caused by addition of Cu, and thereby has excellent levels of oxidation resistance (including water vapor oxidation resistance), thermal fatigue property, and high-temperature fatigue property. The ferritic stainless steel contains, in mass %, C at 0.015% or less, Si at 0.4 to 1.0%, Mn at 1.0% or less, P at 0.040% or less, S at 0.010% or less, Cr at 16 to 23%, Al at 0.2 to 1.0%, N at 0.015% or less, Cu at 1.0 to 2.5%, Nb at 0.3 to 0.65%, Ti at 0.5% or less, Mo at 0.1% or less, and W at 0.1% or less, the Si and the Al satisfying a relation Si (%)≧Al (%).

10 Claims, 5 Drawing Sheets

FERRITIC STAINLESS STEEL WITH EXCELLENT HEAT RESISTANCE

RELATED APPLICATIONS

This is a §371 of International Application No. PCT/JP2010/061733, with an international filing date of Jul. 5, 2010 (WO 2011/024568 A1, published Mar. 3, 2011), which is based on JP 2009-199415, filed Aug. 31, 2009, PCT/JP2009/070632, filed Dec. 3, 2009, JP 2009-279234, filed Dec. 9, 2009, and JP 2010-148604, filed Jun. 30, 2010, the subject matter of which is incorporated by reference.

TECHNICAL FIELD

This disclosure relates to Cr-containing steels, in particular, ferritic stainless steels that have high levels of thermal fatigue property (or thermal fatigue resistance), oxidation resistance, and high-temperature fatigue property (or high-temperature fatigue resistance) and can be suitably used in high temperature exhaust system members such as exhaust pipes and converter cases for automobiles and motorcycles and exhaust air ducts for thermal electric power plants.

BACKGROUND

Exhaust system members of an automobile, including an exhaust manifold, an exhaust pipe, a converter case, and a muffler, are required to have high levels of oxidation resistance, thermal fatigue property, and high-temperature fatigue property (hereinafter these are collectively referred to as "heat resistance"). Upon initiation and stop of engine operation, exhaust system members are repeatedly heated and cooled. These members are restrained by their surrounding members, and thus their thermal expansion and contraction are restricted. As a result, the material itself experiences thermal strain, and this thermal strain causes fatigue phenomena. The thermal fatigue mentioned here represents this type of fatigue phenomenon. While an engine is under operation, the exhaust system members are heated and subjected to vibrations. These vibrations cause an accumulation of strain, also leading to fatigue phenomena. The high-temperature fatigue mentioned above represents this type of fatigue phenomenon. The former is low-cycle fatigue, whereas the latter is high-cycle fatigue. These are completely different types of fatigue phenomena.

As materials for such members requiring heat resistance as above, Cr-containing steels such as Type 429 containing Nb and Si (14Cr-0.9Si-0.4Nb system) are now widely used. However, improved performance of engines has increased the exhaust gas temperature to a level exceeding 900° C., making it impossible to fully achieve performance requirements, in particular, thermal fatigue property, with Type 429.

Some materials have been developed to address this problem, including Cr-containing steels that contain Nb and Si for an improved high temperature proof stress, SUS444 (19Cr-0.5Nb-2Mo) specified in JIS G4305, and ferritic stainless steels containing Nb, Mo, and W (e.g., see Japanese Unexamined Patent Application Publication No. 2004-018921). However, the recent terribly steep rise and fluctuation in the prices of Mo, W, and other rare metals have necessitated developing materials that can be made from inexpensive raw materials and have heat resistance comparable to that of the materials mentioned above.

An example of materials highly resistant to heat and containing no expensive elements such as Mo and W is that disclosed in International Publication No. WO 2003/004714, a ferritic stainless steel for members of automobile exhaust gas flow passages, which is based on a steel containing Cr at 10 to 20 mass % and further contains Nb at 0.50 mass % or less, Cu at 0.8 to 2.0 mass %, and V at 0.03 to 0.20 mass %. Another example is that disclosed in Japanese Unexamined Patent Application Publication No. 2006-117985, a ferritic stainless steel with excellent thermal fatigue property, which is based on a steel containing Cr at 10 to 20 mass % and further contains Ti at 0.05 to 0.30 mass %, Nb at 0.10 to 0.60 mass %, Cu at 0.8 to 2.0 mass %, and B at 0.0005 to 0.02 mass %. Yet another example is that disclosed in Japanese Unexamined Patent Application Publication No. 2000-297355, a ferritic stainless steel for automobile exhaust system components, which is based on a steel containing Cr at 15 to 25 mass % and further contains Cu at 1 to 3 mass %. These steels all contain Cu for improved thermal fatigue property.

Unfortunately, adding Cu as in WO '714, JP '985 and JP '355 admittedly improves thermal fatigue property but, on the other hand, significantly reduces oxidation resistance, ending up with reduced overall heat resistance. Worse yet, steels containing Cu may be somewhat lacking in thermal fatigue property during use under certain temperature conditions.

Some other patent publications have disclosed ferritic stainless steels containing Al for improved characteristics. An example is that disclosed in Japanese Unexamined Patent Application Publication No. 2008-285693, a ferritic stainless steel for automobile exhaust systems, which is based on a steel containing Cr at 13 to 25 mass % and further contains Ni at 0.5 mass % or less, V at 0.5 mass % or less, Nb at >0.5 to 1.0 mass %, Ti at 3×(C+N) to 0.25 mass %, and Al at 0.2 to 2.5 mass %. The addition of Al contributes to increased high-temperature strength. Another example is that disclosed in Japanese Unexamined Patent Application Publication No. 2001-316773, a heat-resistant ferritic stainless steel as a catalyst carrier, which is based on a steel containing Cr at 10 to 25 mass % and further contains Al at 1 to 2.5 mass % and Ti at 3×(C+N) to 20×(C+N). The added Al forms a coating of $Al_2O_3$ that provides excellent oxidation resistance. Yet another example is that disclosed in Japanese Unexamined Patent Application Publication No. 2005-187857, a heat-resistant ferritic stainless steel for hydroforming, which is based on a steel containing Cr at 6 to 20 mass % and further contains Ni at 2 mass % or less, O at 0.008 mass % or less, and any one or two or more of Ti, Nb, V, and Al at 1 mass % or less in total. The added Ti, Nb, V, and/or Al fixes C and N and forms a carbonitride to reduce the disadvantage of C and N, making the steel more formable.

Unfortunately, Al, when added to a steel with a low Si content as in JP '693, preferentially forms an oxide or a nitride and is solid-dissolved in a reduced amount, making the steel somewhat lacking in high-temperature strength. Also, Al, when contained in steel at a high content exceeding 1.0% as in JP '773, significantly reduces room-temperature workability and also causes reduces oxidation resistance rather than improving it because of a high binding affinity to oxygen. The steel disclosed in JP '857, which contains neither Cu nor Al or contains either only at a low content, is somewhat lacking in heat resistance.

However, our research revealed that, as with the steels disclosed in WO '714, JP '985 and JP '355 mentioned above, adding Cu for improved heat resistance admittedly improves thermal fatigue property but, on the other hand, significantly reduces oxidation resistance of the steel itself rather than improving it and often ends up with reduced overall heat resistance. Furthermore, we also found that steels containing Cu may be somewhat lacking in thermal fatigue property during use under certain temperature conditions, for example, conditions under which the maximum temperature is lower than the solid-dissolution temperature of ϵ-Cu.

Although JP '693 and JP '773 state that adding Al leads to great high-temperature strength and excellent oxidation resistance, our research has found that merely adding Al ends up with an insufficient effect and that the balance between the amount of Al and that of Si is important. Steels containing neither Cu nor Al or containing either only at a low content as in JP '857 are somewhat lacking in heat resistance.

The oxidation resistance of steel is usually assessed by an oxidation test in a dry and high-temperature atmosphere. However, an exhaust manifold and other exhaust system members are exposed to an oxidative atmosphere in practical use, and such an atmosphere contains a large amount of vapor. Thus, the existing oxidation tests cannot adequately assess the practical oxidation resistance of steel. As is clear from this fact, the oxidation resistance of steel should be assessed and improved in consideration of that in a water vapor atmosphere (hereinafter also referred to as "water vapor oxidation resistance").

Thus, it could be helpful to develop a technique for producing steel without adding expensive elements such as Mo and W while preventing the oxidation resistance loss after the addition of Cu and improving the characteristics at temperatures tough for the steel (temperatures lower than the solid-dissolution temperature of ϵ-Cu) and thereby provide ferritic stainless steels having excellent levels of oxidation resistance (including water vapor oxidation resistance), thermal fatigue property, and high-temperature fatigue property.

Note that the expression "having excellent levels of oxidation resistance, thermal fatigue property, and high-temperature fatigue property" means that these characteristics of the steel are at least equivalent to those of SUS444. More specifically, this expression means the following: As for oxidation resistance, the oxidation resistance at 950° C. of the steel is at least equivalent to that of SUS444. As for thermal fatigue property, the resistance of the steel to the fatigue from thermal cycling in the temperature range of 100° C. to 850° C. is at least equivalent to that of SUS444. As for high-temperature fatigue property, the high-temperature fatigue property at 850° C. of the steel is at least equivalent to that of SUS444.

SUMMARY

We provide a ferritic stainless steel including C at 0.15 mass % or less, Si at 0.4 to 1.0 mass %, Mn at 1.0 mass % or less, P at 0.040 mass % or less, S at 0.010 mass % or less, Cr at 16 to 23 mass %, Al at 0.2 to 1.0 mass %, N at 0.015 mass % or less, Cu at 1.0 to 2.5 mass %, Nb at 0.3 to 0.65 mass %, Ti at 0.5 mass % or less, Mo at 0.1 mass % or less, and W at 0.1 mass % or less, the Si and the Al satisfying a relation Si (mass %)≧Al (mass %), and Fe and unavoidable impurities as the balance.

DETAILED DESCRIPTION

Figure 1:
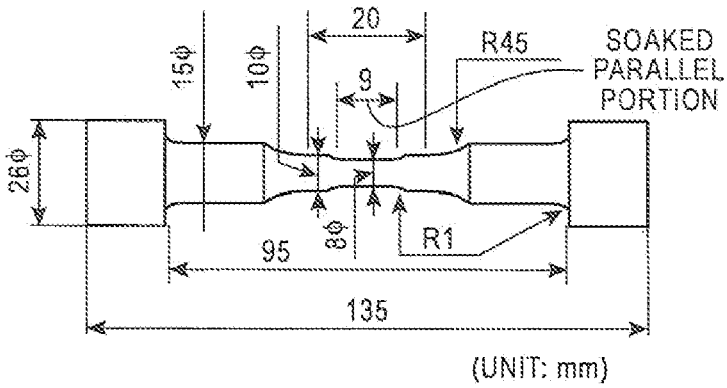
FIG. 1 is a diagram illustrating a thermal fatigue test specimen.

We found that a ferritic stainless steel that contains no expensive elements such as Mo and W is free from the oxidation resistance loss caused by addition of Cu, which is a problem known techniques have faced, and has excellent levels of oxidation resistance (including water vapor oxidation resistance), thermal fatigue property, and high-temperature fatigue property. We discovered the following: 1) As for thermal fatigue property, adding Nb and Cu in combination to make their contents 0.3 to 0.65 mass % and 1.0 to 2.5 mass %, respectively, makes the steel have increased high-temperature strength in a wide range of temperatures, and thus the thermal fatigue property is improved. 2) The oxidation resistance loss caused by addition of Cu can be prevented by adding an appropriate amount of Al (0.2 to 1.0 mass %). 3) Therefore, Cu-containing steels can have an improved level of thermal fatigue property even at temperatures at which they are usually somewhat lacking in this attribute. 4) The water vapor oxidation resistance can be greatly improved by adding an appropriate amount of Si (0.4 to 1.0 mass %) and that the high-temperature fatigue property can also be improved by keeping the amounts of Si and Al (mass %) in a proper balance (Si≧Al).

From these findings, we concluded that it is necessary to adjust the amounts of Nb, Cu, Al, and Si to their respective appropriate ranges specified above to produce a ferritic stainless steel having excellent heat resistance, that is, heat resistance at least equivalent to that of SUS444, without using Mo or W.

Specifically, we provide:

(1) A ferritic stainless steel containing C at 0.015 mass % or less, Si at 0.4 to 1.0 mass %, Mn at 1.0 mass % or less, P at 0.040 mass % or less, S at 0.010 mass % or less, Cr at 16 to 23 mass %, Al at 0.2 to 1.0 mass %, N at 0.015 mass % or less, Cu at 1.0 to 2.5 mass %, Nb at 0.3 to 0.65 mass %, Ti at 0.5 mass % or less, Mo at 0.1 mass % or less, and W at 0.1 mass % or less, the Si and the Al satisfying a relation Si (mass %) Al (mass %), and Fe and unavoidable impurities as the balance.

The ferritic stainless steel further contains:

(2) One or two or more selected from B at 0.003 mass % or less, REM at 0.08 mass % or less, Zr at 0.50 mass % or less, V at 0.5 mass % or less, Co at 0.5 mass % or less, and Ni at 0.5 mass %.

(3) In the ferritic stainless steel, the content of the Ti exceeds 0.15 mass % but is not higher than 0.5 mass %.

(4) In the ferritic stainless steel, the content of the Ti is 0.01 mass % or less.

(5) In the ferritic stainless steel, the content of the V is in the range of 0.01 to 0.5 mass %.

(6) Besides the ingredients specified in (1) above, Co is contained at 0.5 mass % or less.

We thus provide ferritic stainless steels having heat resistance (thermal fatigue property, oxidation resistance, and high-temperature fatigue property) at least equivalent to that of SUS444 (JIS G4305) at low cost, without adding expensive elements such as Mo and W. Thus, the steels can be suitably used in exhaust system members of automobiles and other similar vehicles.

This section first describes a fundamental experiment that served as a springboard for the development of the steels.

With a steel containing C at 0.005 to 0.007 mass %, N at 0.004 to 0.006 mass %, Si at 0.5 mass %, Mn at 0.4 mass %, Cr at 17 mass %, Nb at 0.45 mass %, and Al at 0.35 mass % as a starting composition, Cu was added to reach different contents from 0 to 3 mass %, the obtained compositions of steel were shaped on a laboratory scale into 50-kg steel ingots, and the steel ingots were heated to 1170° C. and hot-rolled into sheet bars each measuring 30 mm in thickness and 150 mm in width. Subsequently, these sheet bars were forged into bars each having a cross section of 35 mm by 35 mm, and the obtained bars were annealed at a temperature of 1030° C. and machined. In this way, thermal fatigue test specimens were prepared to have the dimensions and shape specified in FIG. 1.

Figure 2:
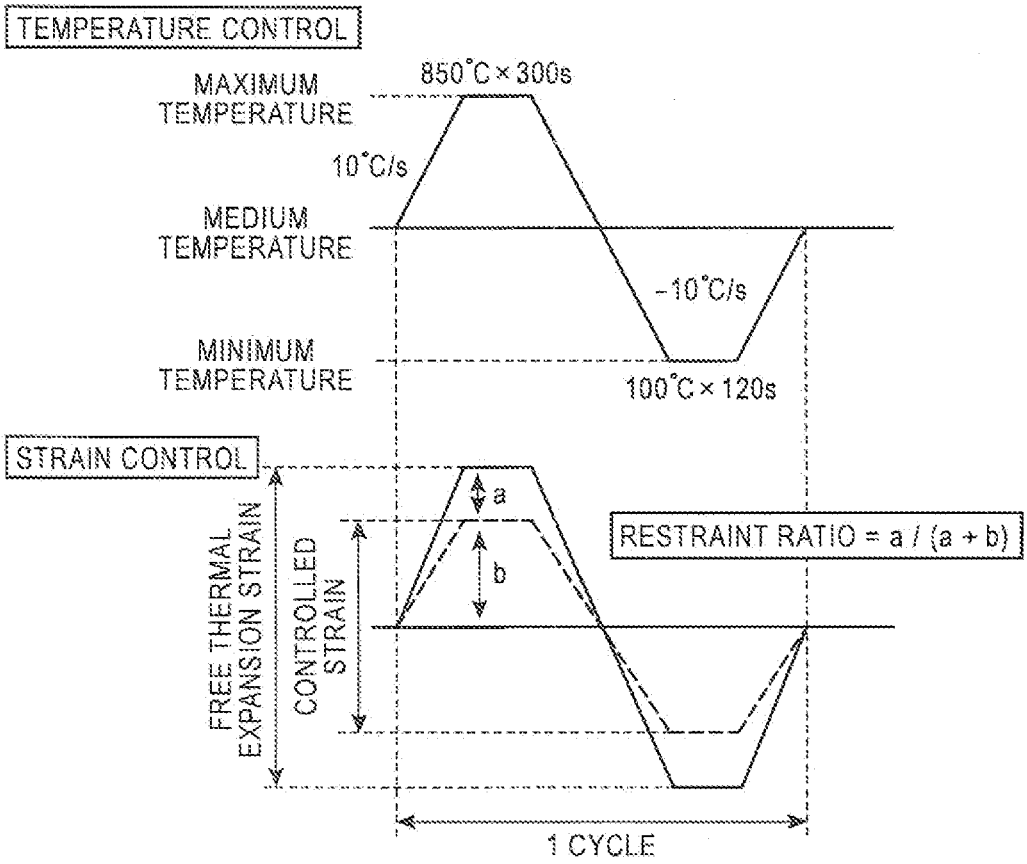
FIG. 2 is a diagram illustrating temperature and restraining conditions in a thermal fatigue test.

Then, each of these test specimens was repeatedly subjected to the thermal treatment specified in FIG. 2, in which the test specimen was heated and cooled within the range from 100° C. to 850° C. with the restraint ratio set at 0.35, and the thermal fatigue life was measured. The thermal fatigue life represents the number of cycles at which the stress first started to continuously decrease from that in the previous cycle. The stress was calculated as the quotient of the load detected at 100° C. divided by the cross sectional area of the soaked parallel portion of a test specimen indicated in FIG. 1. It also corresponds to the number of cycles at which a crack appeared on the test specimen. For comparison, SUS444 (a steel containing Cr at 19 mass %, Nb at 0.5 mass %, and Mo at 2 mass %) was also tested in the same way.

Figure 3:
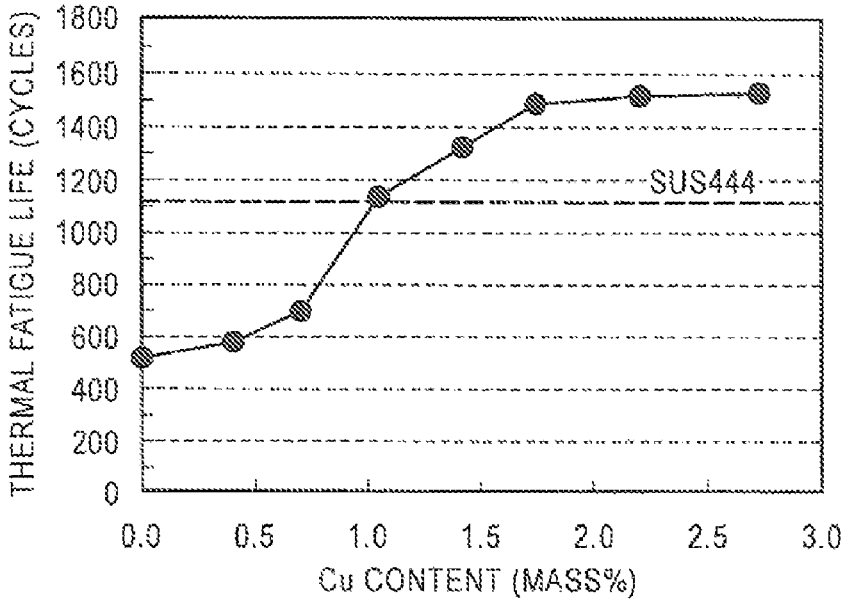
FIG. 3 is a graph showing the effect of the content of Cu on thermal fatigue property.

FIG. 3 illustrates the relationship between thermal fatigue life and content of Cu obtained in this thermal fatigue test. As can be seen from this graph, adding Cu to make its content 1.0 mass % or more provides a thermal fatigue life at least equivalent to that of SUS444 (approximately 1100 cycles), and the thermal fatigue property can be effectively improved by adding Cu to make its content 1.0 mass % or more.

Subsequently, with a steel containing C at 0.006 mass %, N at 0.007 mass %, Mn at 0.2 mass %, Si at 0.5 mass %, Cr at 17 mass %, Nb at 0.49 mass %, and Cu at 1.5 mass % as a starting composition, Al was added to reach different contents from 0 to 2 mass %, and the obtained compositions of steel were shaped on a laboratory scale into 50-kg steel ingots. The steel ingots were hot-rolled, the obtained hot rolled sheets were subjected to hot rolled annealing and then cold-rolled, and the obtained cold rolled sheets were subjected to finishing annealing. In this way, 2-mm thick cold rolled and annealed sheets were obtained. Then, each cold rolled and annealed sheet was cut to provide a test specimen measuring 30 mm by 20 mm. Each test specimen was pierced near the top to have a 4-mm diameter hole, polished with #320 emery paper on both sides and end faces, defatted, and subjected to the continuous oxidation test described below. For comparison, SUS444 was also tested in the same way. Continuous Oxidation Test in Air at 950° C.

A furnace filled with air was heated to 950° C., and each of the test specimens described above was suspended in this furnace for 300 hours. The test specimen was weighed before and after this heating test, and the mass change was calculated and converted to a weight gain by oxidation per unit area ($g/m^2$). With this value, the oxidation resistance was assessed.

Figure 4:
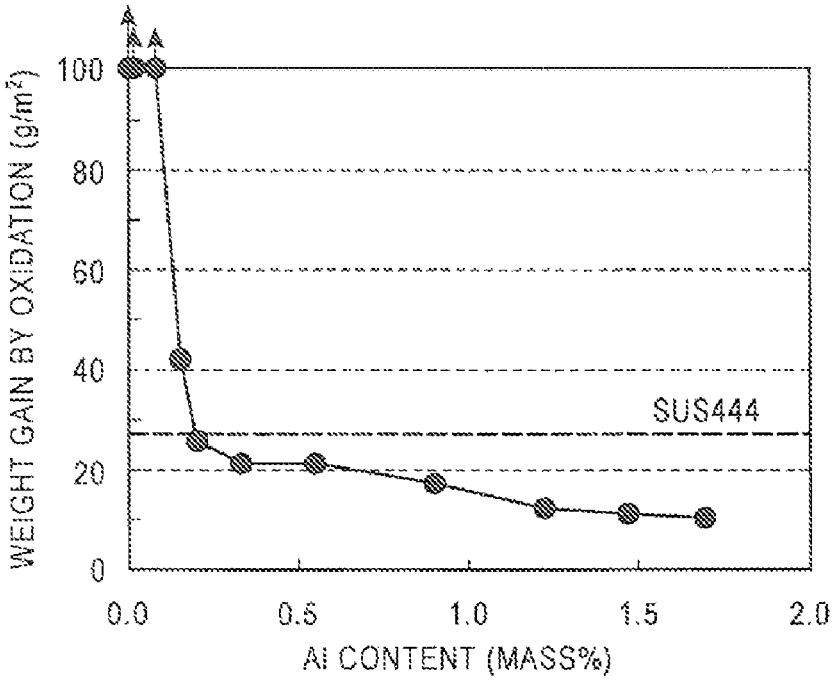
FIG. 4 is a graph showing the effect of the content of Al on oxidation resistance (weight gain by oxidation) at 950° C.

FIG. 4 illustrates the relationship between weight gain by oxidation and content of Al obtained in the test described above. As can be seen from this graph, adding Al to make its content 0.2 mass % or more provides oxidation resistance at least equivalent to that of SUS444 (weight gain by oxidation: 27 $g/m^2$ or less).

Subsequently, with a steel containing C at 0.006 mass %, N at 0.007 mass %, Mn at 0.2 mass %, Al at 0.45 mass %, Cr at 17 mass %, Nb at 0.49 mass %, and Cu at 1.5 mass % as a starting composition, Si was added to reach different contents, and the obtained compositions of steel were shaped on a laboratory scale into 50-kg steel ingots. The steel ingots were hot-rolled, the obtained hot-rolled sheets were subjected to hot rolled annealing and then cold-rolled, and the obtained cold rolled sheets were subjected to finishing annealing. In this way, 2-mm thick cold rolled and annealed sheets were obtained. Then, each cold rolled and annealed sheet was cut to provide a test specimen measuring 30 mm by 20 mm. Each test specimen was pierced near the top to have a 4-mm diameter hole, polished with #320 emery paper on both sides and end faces, defatted, and subjected to the oxidation test described below. For comparison, SUS444 was also tested in the same way.

Continuous Oxidation Test in Water Vapor Atmosphere

A gas mixture containing $CO_2$ at 10%, $H_2O$ at 20%, $O_2$ at 5%, and $N_2$ as the balance was introduced into a furnace at 0.5 L/min, the furnace filled with this water-vapor-containing atmosphere was heated to 950° C., and each of the test specimens described above was suspended in this furnace for 300 hours. The test specimen was weighed before and after this heating test, and the mass change was calculated and converted to a weight gain by oxidation per unit area ($g/m^2$). With this value, the water vapor oxidation resistance was assessed.

Figure 5:
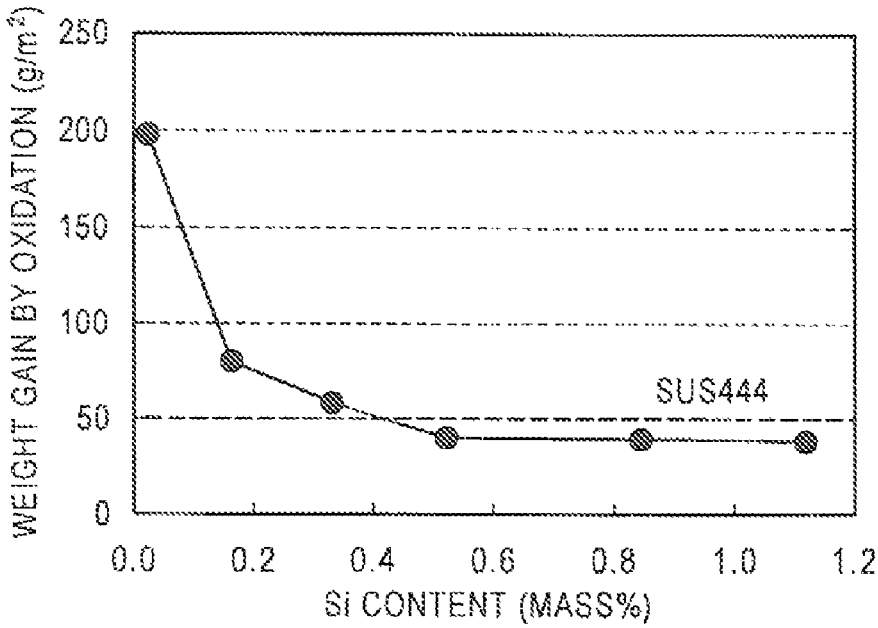
FIG. 5 is a graph showing the effect of the content of Si on water vapor oxidation resistance (weight gain by oxidation) at 950° C.

FIG. 5 illustrates the relationship between weight gain by oxidation and content of Si in a water-vapor-containing atmosphere obtained in the test described above. As can be seen from this graph, adding Si to make its content 0.4 mass % or more provides oxidation resistance at least equivalent to that of SUS444 (weight gain by oxidation: 51 $g/m^2$ or less).

Subsequently, with a steel containing C at 0.006 mass %, N at 0.007 mass %, Mn at 0.2 mass %, Cr at 17 mass %, Nb at 0.49 mass %, and Cu at 1.5 mass % as a starting composition, Si and Al were added to individually reach different contents, and the obtained compositions of steel were shaped on a laboratory scale into 50-kg steel ingots. The steel ingots were hot-rolled, the obtained hot-rolled sheets were subjected to hot rolled annealing and then cold-rolled, and the obtained cold rolled sheets were subjected to finishing annealing. In this way, 2-mm thick cold rolled and annealed sheets were obtained. Then, each cold rolled and annealed sheet was cut to provide a fatigue test specimen having the shape and dimensions specified in FIG. 6, and the test specimens were subjected to the high-temperature fatigue test described below. For comparison, SUS444 was also tested in the same way.

High Temperature Fatigue Test

Each of the test specimens described above was subjected to a Schenck type fatigue test, in which the surface of the steel sheet was exposed to a (reversed) bending stress of 75 MPa at 850° C. with the frequency set at 1300 rpm (22 Hz), and the number of times of vibration was counted until a fracture occurred (fatigue life). With this count, the high-temperature fatigue property was assessed.

Figure 7:
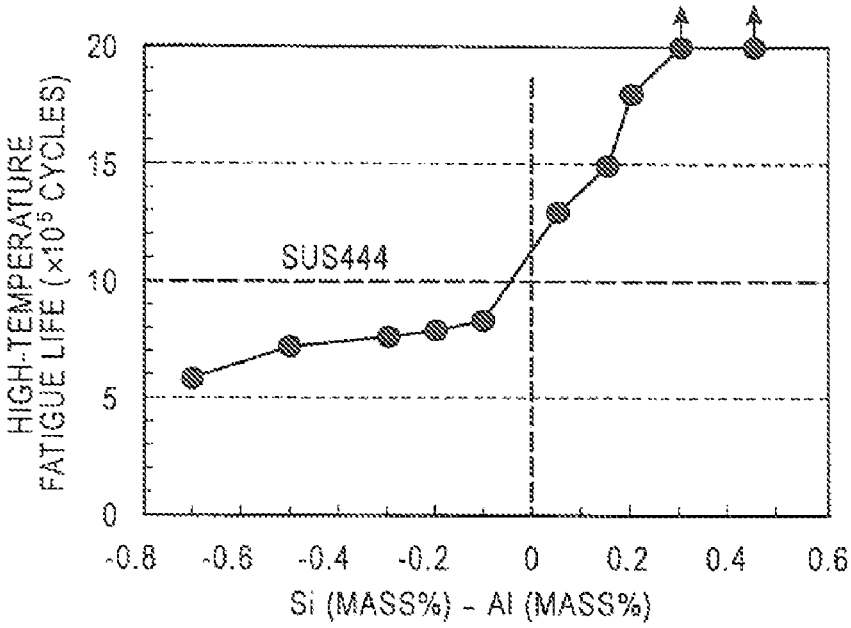
FIG. 7 is a graph showing the effect of the content of Si and that of Al on high-temperature fatigue property.

FIG. 7 illustrates a relationship between high-temperature fatigue life and the difference in content between Si and Al obtained in the test described above. As can be seen from this graph, a high-temperature fatigue life equivalent to or better than that of SUS444 (1.0E+06) can be achieved only when Si and Al satisfy a relation (Si (mass %)≧Al (mass %)).

Then, each of the 2-mm thick cold rolled and annealed sheets prepared for the continuous oxidation test in air described above was cut to provide a JIS 13B tensile test specimen having the following three tensile directions: the direction of rolling (Direction L), the perpendicular to the direction of rolling (Direction C), and 45° to the direction of rolling (Direction D). The test specimens were subjected to a tensile test at room temperature, where the elongation after fracture was measured in each direction, and the mean elongation El was calculated using the following equation:

$$\text{Mean elongation El (\%)}=(E_L+2E_D+E_C)/4$$

where $E_L$ is El (%) in Direction L, $E_D$ is El (%) in Direction D, and $E_C$ is El (%) in Direction C.

Figure 8:
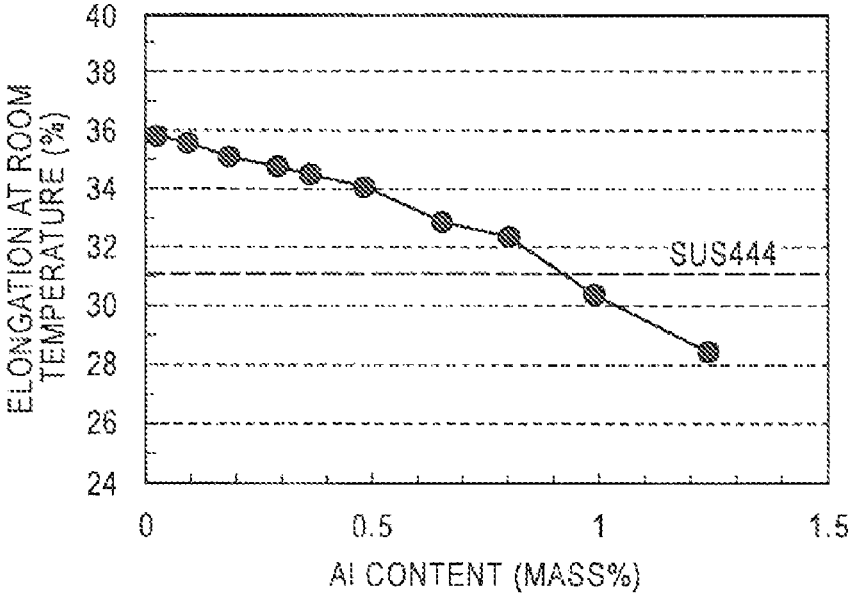
FIG. 8 is a graph showing the effect of the content of Al on elongation at room temperature.

FIG. 8 shows the effect of the content of Al on elongation at room temperature. This graph indicates that the elongation at room temperature decreases as the content of Al increases and that adding Al to make its content higher than 1.0 mass % results in an elongation falling short of that of SUS444 (31%).

Then, we conducted a study on the effect of the content of Ti on oxidation resistance at a high temperature (1000° C.), compared with 950° C. for the similar tests described above.

With a steel containing C at 0.006 mass %, N at 0.007 mass %, Si at 0.7 mass %, Mn at 0.2 mass %, Al at 0.5 mass %, Cr at 17 mass %, Nb at 0.49 mass %, and Cu at 1.5 mass % as a starting composition, Ti was added to reach different contents from 0 to 1.0 mass %, and the obtained compositions of steel were shaped on a laboratory scale into 50-kg steel ingots. The steel ingots were hot-rolled, the obtained hot rolled sheets were subjected to hot rolled annealing and then cold-rolled, and the obtained cold rolled sheets were subjected to finishing annealing. In this way, 2-mm thick cold rolled and annealed sheets were obtained. Then, each cold rolled and annealed sheet was cut to provide a test specimen measuring 30 mm by 20 mm. Each test specimen was pierced near the top to have a 4-mm diameter hole, polished with #320 emery paper on both sides and end faces, defatted, and subjected to the oxidation test at 1000° C. described below. For comparison, SUS444 was also tested in the same way. Continuous Oxidation Test in Air at 1000° C.

A furnace filled with air was heated to 1000° C., and each of the test specimens described above was suspended in this furnace for 300 hours. The test specimen was weighed before and after this heating test, and the mass change was calculated and converted to a weight gain by oxidation per unit area ($g/m^2$). With this value, the oxidation resistance was assessed. For test specimens on which spalling of the oxide (scale spalling) occurred, the detached scale was also collected and included in the weight measurement after the test.

Figure 9:
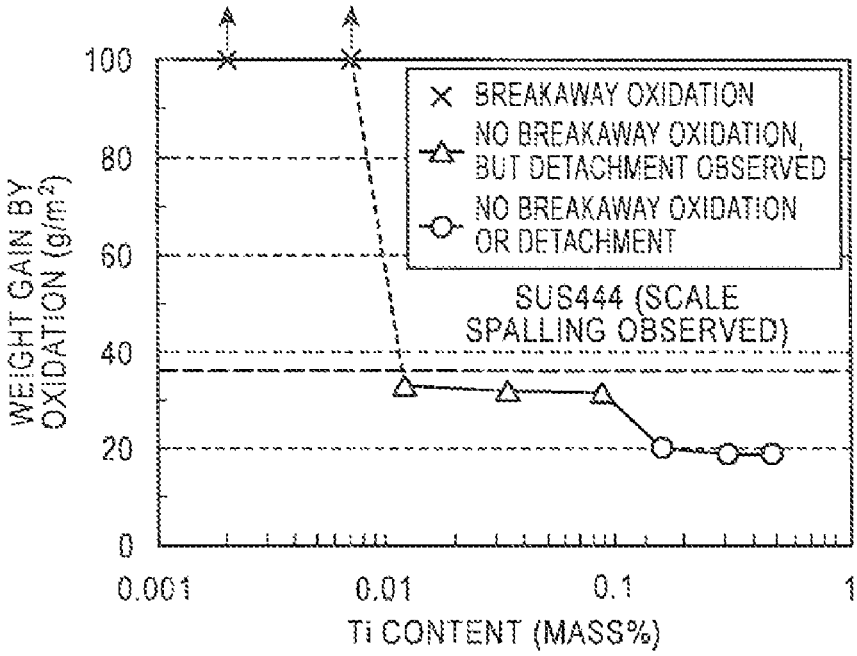
FIG. 9 is a graph showing the effect of the content of Ti on oxidation resistance (weight gain by oxidation) at 1000° C.

FIG. 9 illustrates the relationship between weight gain by oxidation and content of Ti obtained in the oxidation test at 1000° C. described above. This graph gives the following: 1) When the content of Ti is 0.01 mass % or less, serious scale spalling occurs, leading to a weight gain by oxidation of 100 $g/m^2$ or more, namely breakaway oxidation. 2) Adding Ti to make its content higher than 0.01 mass %. However, prevents breakaway oxidation from occurring and provides an equivalent or better oxidation resistance (weight gain by oxidation: 36 $g/m^2$ or less) compared with that of SUS444 (weight gain by oxidation: 36 $g/m^2$), although partial scale spalling occurs. 3) Adding Ti to make its content higher than 0.15 mass % prevents both breakaway oxidation and scale spalling from occurring and provides excellent oxidation resistance.

Then, with one of the Ti-containing steels described above, we conducted a study on the effect of the content of V on toughness.

With a steel containing C at 0.006 mass %, N at 0.007 mass %, Si at 0.7 mass %, Mn at 0.2 mass %, Al at 0.5 mass %, Cr at 17 mass %, Nb at 0.49 mass %, Cu at 1.5 mass %, and Ti at 0.3 mass % as a starting composition, V was added to reach different contents from 0 to 1.0 mass %, and the obtained compositions of steel were shaped on a laboratory scale into 50-kg steel ingots. The steel ingots were hot-rolled, the obtained hot rolled sheets were subjected to hot rolled annealing and then cold-rolled, and the obtained cold rolled sheets were subjected to finishing annealing. In this way, 2-mm thick cold rolled and annealed sheets were obtained. These cold rolled and annealed sheets were cut to provide 2-mm width V-notch impact test specimens in accordance with JIS Z0202. Then, a Charpy impact test was performed at −40° C. in accordance with JIS Z2242, the fracture was visually inspected, and the percent brittle fracture was measured.

Figure 10:
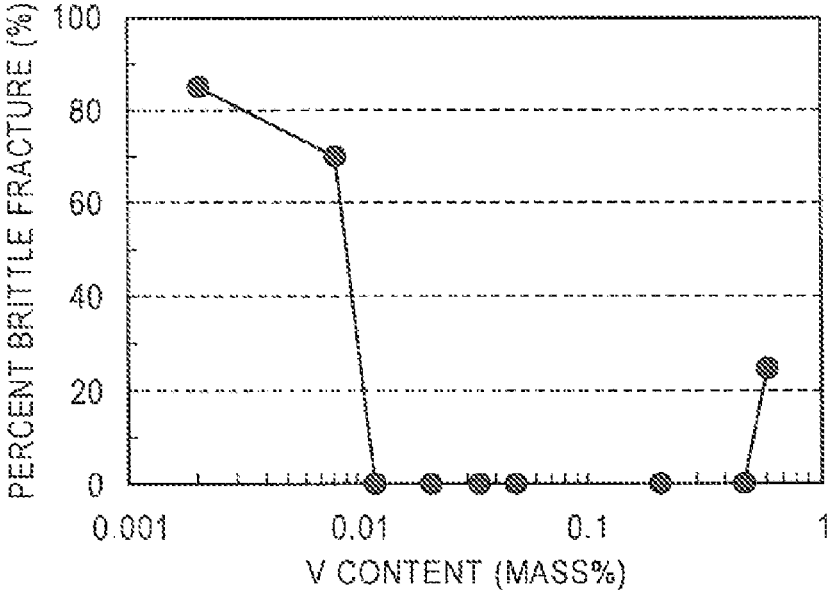
FIG. 10 is a graph showing the effect of the content of V on toughness (percent brittle fracture).

FIG. 10 illustrates the relationship between percent brittle fracture and content of V obtained in the impact test described above. As can be seen from this graph, adding V to make its content 0.01 mass % or more significantly improves toughness and makes percent brittle fracture 0%. However, adding V to make its content higher than 0.5 mass % leads to an increased percent brittle fracture and reduces toughness rather than improving it.

The following describes the ingredients constituting our ferritic stainless steels. C, 0.015 mass % or less C is an element effective to increase the strength of steel. However, adding it to make its content higher than 0.015 mass % leads to significantly reduced toughness and formability. Therefore, the content of C is 0.015 mass % or less. From the viewpoint of ensuring formability, the content of C is preferably 0.008 mass % or less. From the viewpoint of ensuring the strength of the steel for use as an exhaust system member, the content of C is preferably 0.001 mass % or more. More preferably, the content of C is in the range of 0.002 to 0.008 mass %.

Si: 0.4 to 1.0 mass %

Si is an important element, which is necessary to improve oxidation resistance in a water-vapor-containing atmosphere. As shown in FIG. 5, it should be contained at 0.4 mass % or more to ensure a water vapor oxidation resistance at least equivalent to that of SUS444. However, an excessive addition making the Si content higher than 1.0 mass % causes reduced formability, and thus the upper limit is 1.0 mass %. Preferably, the content of Si is in the range of 0.4 to 0.8 mass %.

The reason why addition of Si improves water vapor oxidation resistance has not been fully identified. However, Si, when contained at 0.4 mass % or more, seems to continuously form a dense Si oxide layer on the surface of the steel sheet and prevent gaseous components from intruding from outside. If oxidation resistance to a more corrosive water vapor atmosphere is required, the lower limit of the content of Si is preferably 0.5 mass %.

Si (mass %)≧Al (mass %)

Furthermore, Si is an element important also for the effective use of the ability of Al to reinforce steel by solid dissolution. As described later, Al is an element that has an action to reinforce steel by solid dissolution at high temperatures and an effect of improving high temperature thermal fatigue property. When the content of Al is higher than that of Si, however, Al preferentially forms an oxide or a nitride at high temperatures and is solid-dissolved in a reduced amount, and thus cannot fully contribute to the reinforcement by solid dissolution. On the other hand, when the content of Si is higher than that of Al, Si is preferentially oxidized and forms a continuous dense oxide layer on the surface of the steel sheet. This oxide layer has an effect of preventing oxygen and nitrogen from intruding from outside and diffusing inside so that Al can be kept in a solid-dissolved state without being oxidized or nitrided. As a result, a stable solid-dissolved state of Al is ensured, and high temperature thermal fatigue property is improved. Therefore, Si is added to satisfy a relation Si (mass %) Al (mass %) to achieve high temperature thermal fatigue property at least equivalent to that of SUS444.

Mn: 1.0 mass % or less

Mn is an element added as a deoxidizing agent and to increase the strength of the steel. To have its effects, it is added preferably to make its content 0.05 mass % or more. However, an excessive addition makes the y phase easier to form at high temperatures and leads to reduced heat resistance. The content of Mn is therefore 1.0 mass % or less. Preferably, it is 0.7 mass % or less.

P: 0.040 mass % or less

P is a detrimental element that reduces the toughness of steel, and thus its content is desirably reduced as much as possible. The content of P is thus 0.040 mass % or less. Preferably, it is 0.030 mass % or less.

S: 0.010 mass % or less

S is a detrimental element that produces an adverse effect on formability by reducing the elongation and r value and affects corrosion resistance, a fundamental attribute of stainless steel, and thus its content is desirably reduced as much as possible. The content of S is thus 0.010 mass % or less. Preferably, it is 0.005 mass % or less.

Al: 0.2 to 1.0 mass %

Al is, as shown in FIG. 4, an element indispensable for improving the oxidation resistance of Cu-containing steel. In particular, to achieve oxidation resistance at least equal to that of SUS444, Al should be contained at 0.2 mass % or more. As shown in FIG. 8, however, adding Al to make its content higher than 1.0 mass % makes the steel harder than necessary and lose its formability to a level falling short of that of SUS444 (31%) and also reduces oxidation resistance rather than improving it. The content of Al is therefore in the range of 0.2 to 1.0 mass %. Preferably, it is in the range of 0.3 to 1.0 mass %. If formability is given a priority, the content of Al is preferably in the range of 0.3 to 0.8 mass %. More preferably, it is in the range of 0.3 to 0.5 mass %.

Furthermore, Al is an element that is solid-dissolved in steel and reinforces the steel by solid dissolution, and has the effect of increasing high-temperature strength especially against temperatures exceeding 800° C. Al is thus an important element for an improved high temperature thermal fatigue property. As mentioned above, when the content of Al is higher than that of Si, Al preferentially forms an oxide or a nitride at high temperatures and is solid-dissolved in a reduced amount, and thus has no contribution to reinforcement. In contrast to this, when the content of Al is lower than that of Si, Si is preferentially oxidized and forms a continuous dense oxide layer on the surface of the steel sheet. This oxide layer serves as a barrier to oxygen and nitrogen diffusing inside, so that Al can be kept in a stable solid-dissolved state. In the latter case, reinforcement by solid-dissolved Al thus increases high-temperature strength and improves high-temperature fatigue property. Therefore, it is necessary to satisfy a relation Si (mass %)≧Al (mass %) for the high-temperature fatigue property to be improved.

N: 0.015 mass % or less

N is an element that reduces the toughness and formability of steel and, when its con-tent exceeds 0.015 mass %, these detrimental effects are significant. The content of N is therefore 0.015 mass % or less. From the viewpoint of ensuring toughness and formability, the con-tent of N is preferably reduced as much as possible. It is desirably lower than 0.010 mass %.

Cr: 16 to 23 mass %

Cr is an important element, which is effective to improve corrosion resistance and oxidation resistance, features of stainless steel. However, when its content is lower than 16 mass %, it provides only insufficient oxidation resistance. On the other hand, Cr is also an element that reinforces steel at room temperature by solid dissolution and makes the steel harder and less ductile than necessary. In particular, adding Cr to make its content higher than 23 mass % results in these problems being serious, and the upper limit is thus 23 mass %. Cr is therefore contained at a content in the range of 16 to 23 mass %. Preferably, the content of Cr is in the range of 16 to 20 mass %.

Cu: 1.0 to 2.5 mass %

Cu is, as shown in FIG. 3, an element very effective to improve thermal fatigue property and, for thermal fatigue property at least equivalent to that of SUS444 to be achieved, should be contained at 1.0 mass % or more. Adding Cu to make its content higher than 2.5 mass %, however, causes the ϵ-Cu to precipitate during the cooling process following the heat treatment process and makes the steel harder than necessary and more susceptible to an embrittlement induced by hot working. More importantly, adding Cu admittedly improves thermal fatigue property, but on the other hand reduces the oxidation resistance of the steel itself rather than improving it, ending up with reduced overall heat resistance. The reason for this has not been fully identified. However, Cu seems to concentrate in the Cr-depleted layer in the portions where scale has formed thereon and prevent Cr, an element that should improve the intrinsic oxidation resistance of stainless steel, from diffusing again. The content of Cu is therefore in the range of 1.0 to 2.5 mass %. Preferably, it is in the range of 1.1 to 1.8 mass %.

Nb: 0.30 to 0.65 mass %

Nb is an element that forms a carbonitride with C and N to fix these elements and thereby acts to enhance corrosion resistance, formability, and grain-boundary corrosion resistance at welds, and also increases high-temperature strength and thereby improves thermal fatigue property. These effects are observed when Nb is contained at 0.30 mass % or more. However, adding it to make its content higher than 0.65 mass % makes the Laves phase easier to precipitate and causes the steel to be more brittle. The content of Cu is therefore in the range of 0.30 to 0.65 mass %. Preferably, it is in the range of 0.40 to 0.55 mass %. If toughness is essential, the content of Cu is preferably in the range of 0.40 to 0.49 mass %. More preferably, it is in the range of 0.40 to 0.47 mass %.

Ti: 0.5 mass % or less

Ti is, in the Al-containing steels, an element very effective to improve oxidation resistance. In particular, steels used at high temperatures exceeding 1000° C. and required to have excellent oxidation resistance should contain Ti as an essential additive element. For such oxidation resistance at high temperatures to be achieved, or more specifically for the oxidation resistance at 1000° C. to be equivalent to or better than that of SUS444, Ti is contained preferably at a content higher than 0.01 mass %, as can be seen from FIG. 9. However, an excessive addition making its content higher than 0.5 mass % not only ends up with a saturated effect of improving oxidation resistance, but also causes toughness to be reduced, and the reduced toughness affects productivity in several ways, for example, fractures due to bending and straightening cycles on a hot rolled annealing line. The upper limit of the content of Ti is therefore 0.5 mass %.

Incidentally, with an existing steel for use in an exhaust system member or related components of automobile engines, an exposure of the member to a high temperature may cause the scale that has formed on the surface of the member to detach and thereby lead to a malfunction of the engine. Addition of Ti is also very effective to prevent this kind of scale spalling, and adding Ti to make its content higher than 0.15 mass % drastically reduces scale spalling that would occur at high temperatures, 1000° C. or higher. If the steel is for use in applications in which scale spalling matters, therefore, Ti is contained preferably at a content higher than 0.15 mass % but not higher than 0.5 mass %.

The reason why addition of Ti improves the oxidation resistance of Al-containing steel has not been fully identified. However, the following is a possible explanation. Ti, when added to steel, binds with N at a high temperature and thereby prevents Al from binding with N and precipitate in the form of AlN. This increases the proportion of free Al, and this free Al binds with O to form an Al oxide ($Al_2O_3$) in the boundary between the dense Si oxide layer mentioned above, which has formed on the surface of the steel sheet, and the base metal portion. The resultant double-layered structure, composed of the Si oxide layer mentioned above and the Al oxide, prevents O from intruding into the steel sheet and provides improved oxidation resistance.

Furthermore, as with Nb, Ti fixes C and N and thereby acts to prevent corrosion resistance, formability, and grain-boundary corrosion at welds. In the ingredient systems in which Nb is contained, however, adding Ti to make its content higher than 0.01 mass % ends up with saturation of these effects and also causes solid dissolution to occur making the steel harder than necessary. Worse yet, Ti, which is more likely to bind with N than Nb is, forms coarse TiN from which cracks will emerge, thereby leading to reduced toughness. If the steel is for applications in which corrosion resistance, formability, and grain-boundary corrosion resistance at welds are given a priority whereas oxidation resistance at high temperatures (e.g., 1000° C. or higher) is not particularly required or the steel is for use in applications in which toughness is of particular need, therefore, no active addition of Ti is needed. Instead, it is preferred to reduce the content of Ti as much as possible. If the steel is for use in such applications, therefore, the content of Ti is preferably 0.01 mass % or less.

Mo: 0.1 mass % or less

Mo is an expensive element. Thus, its active addition should be avoided. In some cases, however, the steel may contain Mo carried over from scrap metal and other raw materials at 0.1 mass % or less. The content of Mo is therefore 0.1 mass % or less.

W: 0.1 mass % or less

As with Mo, W is an expensive element. Thus, its active addition should be avoided. In some cases, however, the steel may contain W carried over from scrap metal and other raw materials at 0.1 mass % or less. The content of W is therefore 0.1 mass % or less.

Besides the essential ingredients described above, the ferritic stainless steels can further contain one or two or more of B, REM, Zr, V, Co, and Ni within the ranges specified below.

B: 0.003 mass % or less

B is an element effective to improve the workability of steel, in particular, secondary workability. This effect is obtained when B is contained at 0.0005 mass % or more. However, an excessive addition making its content higher than 0.003 mass % causes BN to be formed and thus reduced workability. When B is added, therefore, its content is preferably 0.003 mass % or less. More preferably, it is in the range of 0.0010 to 0.003 mass %.

REM: 0.08 mass % or less; Zr: 0.50 mass % or less

REM (rare earth metals) and Zr are both elements that improve oxidation resistance and may be contained as necessary. To achieve their effect, they are contained preferably at 0.01 mass % or more and 0.05 mass % or more, respectively. However, adding REM to make their content higher than 0.080 mass % embrittles the steel, and adding Zr to make its content higher than 0.50 mass % causes Zr intermetallics to precipitate and thereby reduces toughness of the steel. When REM and Zr are added, therefore, the content is preferably 0.08 mass % or less and 0.5 mass % or less, respectively.

V: 0.5 mass % or less

V is an element effective to improve both the workability and oxidation resistance of steel. These effects are significant when the content of V is 0.15 mass % or more. An excessive addition making the V content higher than 0.5 mass %, however, causes coarse V(C, N) to precipitate and thereby leads to a deteriorated surface texture. When V is added, therefore, its content is preferably in the range of 0.15 to 0.5 mass %. More preferably, it is in the range of 0.15 to 0.4 mass %.

Furthermore, V is an element also effective to improve the toughness of steel. In particular, as shown in FIG. 10, Ti-containing steels for use in applications in which oxidation resistance at 1000° C. and higher temperatures is needed greatly benefit from this effect of V of improving toughness. This effect is obtained when V is contained at 0.01 mass % or more. However, adding V to make its content higher than 0.5 mass % reduces toughness rather than improving it. If the steel is a Ti-containing steel for use in applications in which toughness is of need, therefore, V is contained preferably at a content in the range of 0.01 to 0.5 mass %.

Incidentally, the above-described toughness improvement effect of V in Ti-containing steels seems to be brought about in the following way: Ti existing in TiN crystallizing in the steel is partially replaced with V and precipitates in the form of slow-glowing (Ti, V)N, and thus coarse nitride, a cause of reduced toughness, is prevented from precipitating.

Co: 0.5 mass % or less

Co is an element effective to improve the toughness of steel. To achieve its effect, Co is contained preferably at 0.0050 mass % or more. However, Co is an expensive element and, worse yet, adding Co to make its content higher than 0.5 mass % ends up with saturation of that effect. When Co is added, therefore, its content is preferably 0.5 mass % or less. More preferably, it is in the range of 0.01 to 0.2 mass %. If cold rolled sheets with excellent toughness are needed, the content of Co is preferably in the range of 0.02 to 0.2 mass %.

Ni: 0.5 mass % or less

Ni is an element that improves the toughness of steel. To achieve its effect, Ni is contained preferably at 0.05 mass % or more. However, Ni is expensive, and it is also a strong y-phase-forming element. It forms the y phase at high temperatures and thereby reduces oxidation resistance. When Ni is added, its content is thus preferably 0.5 mass % or less. More preferably, it is in the range of 0.05 to 0.4 mass %. However, there may be some cases of involuntary and unavoidable impurity with Ni at 0.10 to 0.15 mass % due to the scrap metal or alloy composition.

The following describes a manufacturing method of our ferritic stainless steel.

The manufacturing method of a ferritic stainless steel is not particularly limited. Ordinary methods for manufacturing ferritic stainless steel can all be suitably used. For example, it can be manufactured by the following manufacturing procedure: 1) Make steel have the chemical composition specified above by melting it in a steel converter, an electric furnace, or any other known melting furnace and optionally getting the steel through ladle refining, vacuum refining, or any other secondary refining process. 2) Shape the steel into slabs by continuous casting or ingot casting-blooming rolling. 3) Process the slabs into cold rolled and annealed sheets through hot rolling, hot rolled annealing, pickling, cold rolling, finishing annealing, another round of pickling, and other necessary processes. The cold rolling process mentioned above may be a single round of cold rolling or include two or more rounds straddling process annealing, and the cold rolling, finishing rolling, and pickling processes may be repeatedly performed.

Furthermore, the hot rolled annealing process may be omitted. If it is necessary to modify the surface gloss and roughness of the steel sheets, the cold rolling process or the finishing rolling process may be followed by skin pass rolling.

Here is an explanation of a set of manufacturing conditions preferred in the manufacturing method described above.

In the steel-making process, in which steel is melted and optionally refined, the following is a preferred procedure: Melt steel in a steel converter, an electric furnace, or the like and get the melted steel through secondary refining by the VOD method (Vacuum Oxygen Decarburization method) or any other appropriate method to make the steel contain the essential ingredients described above and necessary additive components. The melted steel can be processed into steel raw material by any known method. From the aspect of productivity and quality, however, continuous casting is preferred. Then, preferably, the steel raw material is heated at 1000 to 1250° C. and hot-rolled into hot rolled sheets having a desired thickness. Of course, the steel raw material may be hot-worked into any form other than sheets. Then, preferably, the hot rolled sheets are subjected to batch annealing at a temperature in the range of 600 to 800° C. or continuous annealing at a temperature in the range of 900 to 1100° C., whichever is necessary, and descaled by pickling or any other appropriate treatment to provide a hot rolled product. If necessary, the hot rolled sheets may be descaled by shot blasting before the pickling process.

Furthermore, the hot rolled and annealed sheets described above may be subjected to cold rolling and other necessary processes to provide a cold rolled product. In this case, the cold rolling process may be a single round of cold rolling or, for productivity and required quality to be ensured, include two or more rounds of cold rolling straddling process annealing. The total rolling reduction after the single or two or more rounds of cold rolling is preferably 60% or higher and more preferably 70% or higher. Then, preferably, the cold rolled steel sheets are subjected to continuous annealing (finishing annealing) at a temperature preferably in the range of 900 to 1150° C., more preferably 950 to 1120° C., and then to pickling to provide a cold rolled product. Depending on the intended applications, the finish-annealed steel sheets may be subjected to skin pass rolling and other necessary processes to have their shape, surface roughness, and characteristics modified.

The hot rolled or cold rolled product obtained in such a way as above is then shaped in different ways depending on its intended applications, through cutting, bending work, stretch work, drawing compound, and other necessary processes, to provide exhaust pipes and converter cases for automobiles and motorcycles, exhaust air ducts for thermal electric power plants, fuel cell members such as separators, inter connectors, and reformers, and so forth. The method for welding these members is not particularly limited. Appropriate methods include ordinary arc welding methods with MIG (Metal Inert Gas), MAG (Metal Active Gas), TIG (Tungsten Inert Gas) or any other appropriate gas, resistance welding methods such as spot welding and seam welding, and high-frequency resistance or high frequency induction welding methods such as electric resistance welding.

EXAMPLE 1

The steels having the chemical compositions specified as Nos. 1 to 34 in Table 1-1 and Table 1-2 were melted in a vacuum melting furnace and casted into 50-kg steel ingots. Each steel ingot was hot-rolled and then divided into two pieces. Then, one of the two divided pieces was heated to 1170° C. and hot-rolled into a 5-mm thick hot rolled sheet, the obtained hot rolled sheet was subjected to hot rolled annealing at a temperature of 1020° C. and subsequent pickling, the obtained sheet was cold-rolled at a rolling reduction of 60%, the obtained cold rolled sheet was subjected to finishing annealing at a temperature of 1030° C., and the finish-annealed sheet was cooled at an average cooling rate of 20° C./sec and then pickled to provide a 2-mm thick cold rolled and annealed sheet. The cold rolled and annealed sheets obtained in this way were subjected to the two oxidation tests and high temperature fatigue test described later. For reference, SUS444 (No. 35) and steels corresponding in chemical composition to WO '714, JP '985, JP '355, JP '693, JP '773 and JP '857 (Nos. 36 to 41) were also processed into cold rolled and annealed sheets in the same way as described above and subjected to the evaluation tests.

Continuous Oxidation Test in Air

Each of the cold rolled and annealed sheets obtained in the way described above was cut to provide a test specimen measuring 30 mm by 20 mm. Each test specimen was pierced near the top to have a 4-mm diameter hole, polished with #320 emery paper on both sides and end faces, defatted, suspended in a furnace filled with air and preheated to a constant temperature of 950° C. or 1000° C., and left in this state for 300 hours. Before and after the test, each test specimen was weighed, the mass change was calculated from the measured mass and the baseline mass, which was measured in advance, and the weight gain by oxidation ($g/m^2$) was determined. For each steel, this test was conducted twice, and the average value was used to assess its continuous oxidation resistance. As for the continuance oxidation test in air at 1000° C., the steels were assessed in accordance with the following criteria considering both the weight gain by oxidation and scale spalling:

- x: Breakaway oxidation (weight gain by oxidation ≧100 $g/m^2$) observed;
- Δ: No breakaway oxidation observed, but partial scale spalling observed;
- ○: No breakaway oxidation or scale spalling observed.

Continuous Oxidation Test in Water Vapor Atmosphere

Each of the cold rolled and annealed sheets obtained in the way described above was cut to provide a test specimen measuring 30 mm by 20 mm. Each test specimen was pierced near the top to have a 4-mm diameter hole, polished with #320 emery paper on both sides and end faces, defatted, and then subjected to an oxidation test in which a gas mixture containing $CO_2$ at 10 vol %, $H_2O$ at 20 vol %, $O_2$ at 5 vol %, and $N_2$ as the balance was introduced into a furnace at 0.5 L/min, the furnace filled with this water-vapor-containing atmosphere was heated to 950° C., and then the test specimen was suspended in this furnace for 300 hours. Before and after the test, each test specimen was weighed, the mass change was calculated from the measured mass and the baseline mass, which was measured in advance, and the weight gain by oxidation ($g/m^2$) was determined.

High-Temperature Fatigue Test

Figure 6:
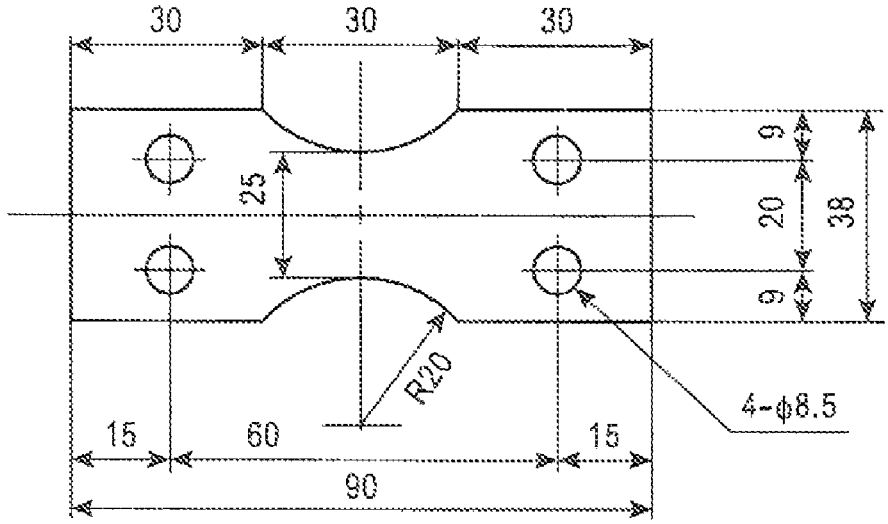
FIG. 6 is a diagram illustrating a high-temperature fatigue test specimen.

Each of the cold rolled and annealed sheets obtained in the way described above was cut to provide a test specimen having the shape and dimensions specified in FIG. 6. Each test specimen was subjected a Schenck type fatigue test, in which the surface of the steel sheet was exposed to a (reversed) bending stress of 75 MPa at 850° C. with the frequency set at 1300 rpm (22 Hz), and the number of times of vibration was counted until a fracture occurred (fatigue life). With this count, the high-temperature fatigue property was assessed.

Tensile Test at Room Temperature

Each of the 2-mm thick cold rolled and annealed sheets described above was cut to provide a JIS 13B tensile test specimen having the following three tensile directions: the direction of rolling (Direction L), the perpendicular to the direction of rolling (Direction C), and 45° to the direction of rolling (Direction D). The test specimens were subjected to a tensile test at room temperature, where the elongation after fracture was measured in each direction, and the mean elongation El was calculated using the following equation:

$$\text{Mean elongation El (\%)}=(E_L+2E_D+E_C)/4$$

where $E_L$ is El (%) in Direction L, $E_D$ is El (%) in Direction D, and $E_C$ is El (%) in Direction C.

EXAMPLE 2

The remaining one of the two pieces of each 50-kg steel ingot divided in Example 1 was heated to 1170° C. and hot-rolled into a sheet bar measuring 30 mm in thickness and 150 mm in width. The sheet bars obtained in this way were forged into bars each measuring 35 mm square, and the obtained bars were annealed at a temperature of 1030° C. and machined to have the shape and dimensions specified in FIG. 1. The thermal fatigue test specimens obtained in this way were subjected to the thermal fatigue test described below. For reference, SUS444 and steels corresponding in chemical composition to those disclosed in WO '714, JP '985, JP '355, JP '693, JP '773 and JP '857 (Reference Examples 1 to 6) were also processed into test specimens in the same way as described above and subjected to the thermal fatigue test.

Thermal Fatigue Test

The thermal fatigue test was conducted as illustrated in FIG. 2. Each of the test specimens described above was repeatedly heated and cooled within the range from 100° C. to 850° C. with the restraint ratio set at 0.35. The heating rate and the cooling rate were both set at 10° C./sec, the holding time at 100° C. was set at two minutes, and the holding time at 850° C. was set at five minutes. The thermal fatigue life was defined as the number of cycles at which the stress first started to continuously decrease from that in the previous cycle. The stress was calculated as the quotient of the load detected at 100° C. divided by the cross section of the soaked parallel portion of a test specimen (see FIG. 1).

Table 2 summarizes the results of the tests described in Example 1, or more specifically continuous oxidation tests in air at 950° C. and 1000° C., a continuous oxidation test in water vapor atmosphere, and a high-temperature fatigue test, as well as those of the thermal fatigue test described in Example 2. As is clear from Table 2, the steels tested as our Examples (Nos. 1 to 15), which satisfied our requirements on chemical composition, all had equivalent or better levels of oxidation resistance at 950° C., thermal fatigue property, and high-temperature fatigue property compared with those of SUS444 (No. 35). As for the result of the continuous oxidation test in air at 1000° C., the steels tested as our Examples in which Ti was contained at a content higher than 0.01 mass % but not higher than 0.15 mass % (Nos. 9, 12, and 13) were comparable to SUS444 (No. 35), and the steels tested as our Examples in which the content of Ti exceeded 0.15 mass % (Nos. 10, 11, 14, and 15) were better than SUS444. On the other hand, the steels tested as Comparative Examples (Nos. 16 to 34), which deviated from our steels, and the steels corresponding to some Reference Examples of the background art (Nos. 36 to 41) were inferior in all of oxidation resistance at 950° C., thermal fatigue property, and high-temperature fatigue property.

INDUSTRIAL APPLICABILITY

Our ferritic stainless steels not only are suitable for use in exhaust system members of automobiles and other similar vehicles, but also can be suitably used in exhaust system members of thermal electric power systems and in members of solid-oxide fuel cells, to which similar resistance requirements apply.

TABLE 1-1

| Steel | Chemical ingredients (mass %) | | | | | | | | |
|---|---|---|---|---|---|---|---|---|---|
| No. | C | Si | Mn | P | S | Al | Cr | Cu | Nb |
| 1 | 0.011 | 0.82 | 0.41 | 0.020 | 0.002 | 0.72 | 17.1 | 1.21 | 0.44 |
| 2 | 0.007 | 0.86 | 0.18 | 0.028 | 0.003 | 0.25 | 17.4 | 1.47 | 0.50 |
| 3 | 0.006 | 0.45 | 0.23 | 0.033 | 0.004 | 0.44 | 17.0 | 1.53 | 0.47 |
| 4 | 0.008 | 0.52 | 0.21 | 0.030 | 0.004 | 0.39 | 17.1 | 1.45 | 0.48 |
| 5 | 0.008 | 0.94 | 0.34 | 0.018 | 0.001 | 0.65 | 18.5 | 1.21 | 0.43 |
| 6 | 0.006 | 0.78 | 0.28 | 0.025 | 0.003 | 0.41 | 17.2 | 1.26 | 0.45 |
| 7 | 0.009 | 0.65 | 0.20 | 0.023 | 0.003 | 0.33 | 17.9 | 1.37 | 0.46 |
| 8 | 0.007 | 0.75 | 0.23 | 0.024 | 0.002 | 0.38 | 17.5 | 1.40 | 0.45 |
| 9 | 0.007 | 0.71 | 0.18 | 0.022 | 0.002 | 0.39 | 17.5 | 1.34 | 0.45 |
| 10 | 0.006 | 0.86 | 0.21 | 0.024 | 0.002 | 0.44 | 17.4 | 1.26 | 0.43 |
| 11 | 0.007 | 0.74 | 0.20 | 0.025 | 0.002 | 0.35 | 17.5 | 1.44 | 0.44 |
| 12 | 0.009 | 0.91 | 0.22 | 0.023 | 0.003 | 0.39 | 17.6 | 1.31 | 0.48 |
| 13 | 0.008 | 0.53 | 0.19 | 0.022 | 0.002 | 0.31 | 17.1 | 1.19 | 0.42 |
| 14 | 0.006 | 0.68 | 0.20 | 0.025 | 0.002 | 0.34 | 17.0 | 1.35 | 0.47 |
| 15 | 0.008 | 0.85 | 0.20 | 0.026 | 0.003 | 0.46 | 17.8 | 1.43 | 0.45 |
| 16 | 0.006 | 0.19 | 0.13 | 0.032 | 0.004 | 0.37 | 17.5 | 1.35 | 0.43 |
| 17 | 0.005 | 0.35 | 0.28 | 0.026 | 0.002 | 0.51 | 17.3 | 1.56 | 0.41 |
| 18 | 0.008 | 0.09 | 0.63 | 0.029 | 0.003 | 1.12 | 16.2 | 1.42 | 0.46 |
| 19 | 0.005 | 0.27 | 0.33 | 0.022 | 0.001 | 0.48 | 17.7 | 1.46 | 0.48 |
| 20 | 0.004 | 0.19 | 0.33 | 0.029 | 0.002 | 0.39 | 21.6 | 1.77 | 0.39 |
| 21 | 0.007 | 0.17 | 0.23 | 0.029 | 0.003 | 0.47 | 17.2 | 1.39 | 0.45 |

TABLE 1-1-continued

| | | | | | | | | | |
|---|---|---|---|---|---|---|---|---|---|
| 22 | 0.006 | 0.41 | 0.09 | 0.033 | 0.001 | 0.66 | 18.2 | 1.61 | 0.40 |

| Steel | Chemical ingredients (mass %) | | | | | | |
|---|---|---|---|---|---|---|---|
| No. | Ti | Mo | W | N | Others | Si-Al | Remarks |
| 1 | 0.009 | 0.04 | 0.02 | 0.004 | — | 0.10 | Example |
| 2 | 0.006 | 0.03 | 0.03 | 0.006 | V: 0.04 | 0.61 | Example |
| 3 | 0.004 | 0.01 | 0.04 | 0.005 | V: 0.08 | 0.01 | Example |
| 4 | 0.003 | 0.02 | 0.02 | 0.008 | V: 0.06 | 0.13 | Example |
| 5 | 0.007 | 0.01 | 0.03 | 0.006 | V: 0.19 | 0.29 | Example |
| 6 | 0.005 | 0.02 | 0.01 | 0.008 | Ni: 0.29 | 0.37 | Example |
| 7 | 0.009 | 0.02 | 0.02 | 0.007 | Co: 0.023 | 0.32 | Example |
| 8 | 0.008 | 0.02 | 0.02 | 0.008 | Co: 0.011 | 0.37 | Example |
| 9 | 0.080 | 0.01 | 0.01 | 0.009 | V: 0.21 | 0.32 | Example |
| 10 | 0.190 | 0.01 | 0.01 | 0.008 | V: 0.33 | 0.42 | Example |
| 11 | 0.310 | 0.02 | 0.01 | 0.008 | V: 0.29, Ni: 0.25 | 0.39 | Example |
| 12 | 0.020 | 0.01 | 0.01 | 0.007 | V: 0.15 | 0.52 | Example |
| 13 | 0.130 | 0.01 | 0.01 | 0.009 | V: 0.38 | 0.22 | Example |
| 14 | 0.240 | 0.02 | 0.01 | 0.007 | V: 0.12, B: 0.0005 | 0.34 | Example |
| 15 | 0.160 | 0.01 | 0.01 | 0.008 | V: 0.18, Ni: 0.11 | 0.39 | Example |
| 16 | 0.006 | 0.02 | 0.04 | 0.008 | — | −0.18 | Comparative Example |
| 17 | 0.002 | 0.03 | 0.01 | 0.007 | — | −0.16 | Comparative Example |
| 18 | 0.051 | 0.04 | 0.01 | 0.008 | — | −1.03 | Comparative Example |
| 19 | 0.006 | 0.02 | 0.01 | 0.011 | — | −0.21 | Comparative Example |
| 20 | 0.005 | 0.01 | 0.01 | 0.008 | — | −0.20 | Comparative Example |
| 21 | 0.004 | 0.01 | 0.01 | 0.008 | B: 0.0009, V: 0.051 | −0.30 | Comparative Example |
| 22 | 0.090 | 0.05 | 0.01 | 0.009 | REM: 0.013, Ni: 0.33 | −0.25 | Comparative Example |

TABLE 1-2

| Steel | Chemical ingredients (mass %) | | | | | | | | |
|---|---|---|---|---|---|---|---|---|---|
| No. | C | Si | Mn | P | S | Al | Cr | Cu | Nb |
| 23 | 0.008 | 0.37 | 0.71 | 0.018 | 0.003 | 0.88 | 17.8 | 1.28 | 0.52 |
| 24 | 0.006 | 0.31 | 0.35 | 0.030 | 0.002 | 0.14 | 17.1 | 1.46 | 0.44 |
| 25 | 0.008 | 0.23 | 0.66 | 0.028 | 0.004 | 1.62 | 17.7 | 1.61 | 0.49 |
| 26 | 0.006 | 0.32 | 0.55 | 0.028 | 0.003 | 0.69 | 17.4 | 0.87 | 0.51 |
| 27 | 0.007 | 0.23 | 0.25 | 0.027 | 0.002 | 0.47 | 17.6 | 1.18 | 0.44 |
| 28 | 0.003 | 0.09 | 0.12 | 0.025 | 0.003 | 0.46 | 17.5 | 1.26 | 0.42 |
| 29 | 0.008 | 0.15 | 0.39 | 0.021 | 0.001 | 0.51 | 17.3 | 1.38 | 0.48 |
| 30 | 0.006 | 0.32 | 0.34 | 0.024 | 0.002 | 0.46 | 17.7 | 1.22 | 0.46 |
| 31 | 0.009 | 0.18 | 0.15 | 0.027 | 0.004 | 0.49 | 17.4 | 1.48 | 0.47 |
| 32 | 0.007 | 0.27 | 0.15 | 0.027 | 0.003 | 0.53 | 19.1 | 1.28 | 0.45 |
| 33 | 0.005 | 0.03 | 0.11 | 0.024 | 0.002 | 0.51 | 18.2 | 1.19 | 0.45 |
| 34 | 0.007 | 0.73 | 0.11 | 0.025 | 0.002 | 0.89 | 17.9 | 1.71 | 0.39 |
| 35 | 0.008 | 0.31 | 0.42 | 0.031 | 0.003 | 0.019 | 18.7 | 0.02 | 0.52 |
| 36 | 0.008 | 0.32 | 0.05 | 0.028 | 0.002 | 0.01 | 17.02 | 1.93 | 0.33 |
| 37 | 0.009 | 0.46 | 0.54 | 0.029 | 0.003 | 0.002 | 18.90 | 1.36 | 0.35 |
| 38 | 0.006 | 0.22 | 0.05 | 0.005 | 0.0052 | 0.052 | 18.8 | 1.65 | 0.42 |
| 39 | 0.005 | 0.20 | 0.30 | 0.030 | 0.005 | 0.05 | 17.0 | — | 0.52 |
| 40 | 0.009 | 1.70 | 0.60 | 0.030 | 0.002 | 1.00 | 17.0 | — | 0.45 |
| 41 | 0.002 | 0.93 | 0.86 | 0.021 | 0.003 | 0.25 | 15.5 | — | 0.65 |

| Steel | Chemical ingredients (mass %) | | | | | | |
|---|---|---|---|---|---|---|---|
| No. | Ti | Mo | W | N | Others | Si-Al | Remarks |
| 23 | 0.002 | 0.01 | 0.02 | 0.007 | Co: 0.04, Zr: 0.06 | −0.51 | Comparative Example |
| 24 | 0.006 | 0.01 | 0.02 | 0.009 | — | 0.17 | Comparative Example |
| 25 | 0.004 | 0.05 | 0.01 | 0.008 | — | −1.39 | Comparative Example |
| 26 | 0.004 | 0.02 | 0.01 | 0.009 | — | −0.37 | Comparative Example |
| 27 | 0.003 | 0.06 | 0.02 | 0.008 | V: 0.18 | −0.24 | Comparative Example |
| 28 | 0.008 | 0.05 | 0.03 | 0.007 | V: 0.22 | −0.37 | Comparative Example |
| 29 | 0.024 | 0.02 | 0.06 | 0.008 | V: 0.29 | −0.36 | Comparative Example |
| 30 | 0.005 | 0.06 | 0.02 | 0.005 | V: 0.38 | −0.14 | Comparative Example |
| 31 | 0.014 | 0.04 | 0.03 | 0.006 | V: 0.44 | −0.31 | Comparative Example |
| 32 | 0.004 | 0.05 | 0.02 | 0.007 | V: 0.20 | −0.26 | Comparative Example |
| 33 | 0.006 | 0.05 | 0.03 | 0.006 | V: 0.23 | −0.48 | Comparative Example |
| 34 | 0.002 | 0.01 | 0.02 | 0.007 | V: 0.34 | −0.16 | Comparative Example |
| 35 | 0.003 | 1.87 | 0.02 | 0.008 | — | 0.291 | SUS444 |
| 36 | 0.002 | 0.01 | 0.02 | 0.010 | Ni: 0.10, V: 0.10 | 0.31 | Reference Example 1 |
| 37 | 0.080 | 0.01 | 0.02 | 0.007 | Ni: 0. 10, V: 0 03, B: 0.0030 | 0.458 | Reference Example 2 |

TABLE 1-2-continued

| | | | | | | | |
|---|---|---|---|---|---|---|---|
| 38 | 0.090 | 0.02 | 0.02 | 0.006 | Ni: 0.15 | 0.168 | Reference Example 3 |
| 39 | 0.110 | — | — | 0.010 | Ni: 0.10, V: 0.10 | 0.15 | Reference Example 4 |
| 40 | 0.170 | — | — | 0.007 | Ni: 0.10, V: 0.10 | 0.70 | Reference Example 5 |
| 41 | — | — | — | 0.003 | Ni: 0.55 | 0.68 | Reference Example 6 |

Note)
Reference Example 1: Example 3 in Patent Document 2;
Reference Example 2: Example 7 in Patent Document 3;
Reference Example 3: Example 5 in Patent Document 4;
Reference Example 4: Comparative Example A in Patent Document 5;
Reference Example 5: Comparative Example R in Patent Document 5;
Reference Example 6: Example 3 in Patent Document 7

TABLE 2

| Steel No. | Thermal fatigue life (cycles) | Weight gain by oxidation at 950° C. ($g/m^2$) | Assessment of weight gain by oxidation* at 1000° C. | Weight gain by water vapor oxidation ($g/m^2$) | 0.2% proof stress at 850° C. (MPa) | High-temperature fatigue life at 850° C., 75 MPa ($\times 10^5$ cycles) | Elongation at room temperature (%) | Remarks |
|---|---|---|---|---|---|---|---|---|
| 1 | 1210 | 18 | × | 40 | 31 | 13 | 32 | Example |
| 2 | 1300 | 25 | × | 39 | 30 | >20 | 35 | Example |
| 3 | 1350 | 21 | × | 48 | 31 | 11 | 33 | Example |
| 4 | 1280 | 22 | × | 41 | 32 | 15 | 34 | Example |
| 5 | 1260 | 12 | × | 37 | 36 | >20 | 32 | Example |
| 6 | 1290 | 22 | × | 43 | 33 | >20 | 34 | Example |
| 7 | 1270 | 24 | × | 42 | 32 | >20 | 34 | Example |
| 8 | 1250 | 21 | × | 41 | 32 | >20 | 33 | Example |
| 9 | 1310 | 20 | Δ | 35 | 32 | >20 | 33 | Example |
| 10 | 1330 | 18 | ○ | 34 | 35 | >20 | 34 | Example |
| 11 | 1300 | 19 | ○ | 35 | 34 | >20 | 33 | Example |
| 12 | 1290 | 20 | Δ | 35 | 35 | >20 | 33 | Example |
| 13 | 1300 | 21 | Δ | 37 | 33 | >20 | 34 | Example |
| 14 | 1340 | 20 | ○ | 36 | 32 | >20 | 33 | Example |
| 15 | 1360 | 18 | ○ | 34 | 33 | >20 | 32 | Example |
| 16 | 1230 | 21 | × | 82 | 21 | 5.8 | 35 | Comparative Example |
| 17 | 1330 | 20 | × | 55 | 26 | 8.3 | 33 | Comparative Example |
| 18 | 1270 | 16 | × | >100 | 23 | 6.2 | 30 | Comparative Example |
| 19 | 1300 | 21 | × | 66 | 25 | 8.1 | 33 | Comparative Example |
| 20 | 1450 | 21 | × | 80 | 24 | 7.0 | 32 | Comparative Example |
| 21 | 1260 | 21 | × | 85 | 23 | 6.4 | 34 | Comparative Example |
| 22 | 1390 | 18 | × | 50 | 26 | 6.8 | 31 | Comparative Example |
| 23 | 1210 | 17 | × | 53 | 25 | 6.6 | 31 | Comparative Example |
| 24 | 1290 | 80 | × | 79 | 25 | 6.1 | 36 | Comparative Example |
| 25 | 1400 | 11 | × | 60 | 27 | 7.7 | 27 | Comparative Example |
| 26 | 820 | 14 | × | 58 | 15 | 4.8 | 36 | Comparative Example |
| 27 | 1200 | 15 | × | 71 | 25 | 7.2 | 35 | Comparative Example |
| 28 | 1230 | 15 | × | >100 | 24 | 9.1 | 35 | Comparative Example |
| 29 | 1260 | 14 | × | 79 | 27 | 8.2 | 35 | Comparative Example |
| 30 | 1210 | 14 | × | 57 | 26 | 7.3 | 35 | Comparative Example |
| 31 | 1310 | 14 | × | 78 | 23 | 6.5 | 34 | Comparative Example |
| 32 | 1240 | 15 | × | 56 | 21 | 6.4 | 35 | Comparative Example |
| 33 | 1210 | 15 | × | >100 | 20 | 5.4 | 35 | Comparative Example |
| 34 | 1430 | 13 | × | 34 | 27 | 8.8 | 31 | Comparative Example |
| 35 | 1120 | 27 | Δ | 51 | 29 | 10 | 31 | SUS444 |
| 36 | 1480 | >100 | × | >100 | 28 | 8.7 | 31 | Reference Example 1 |
| 37 | 1240 | >100 | × | >100 | 23 | 6.0 | 35 | Reference Example 2 |
| 38 | 1400 | >100 | × | >100 | 26 | 7.1 | 34 | Reference Example 3 |
| 39 | 660 | >100 | × | >100 | 13 | 3.7 | 37 | Reference Example 4 |
| 40 | 780 | 15 | Δ | 32 | 28 | >20 | 27 | Reference Example 5 |
| 41 | 850 | 24 | × | 89 | 22 | >20 | 37 | Reference Example 6 |

* ○: No breakaway oxidation or scale spalling observed;
Δ: No breakaway oxidation observed, but partial scale spalling observed;
×: Breakaway oxidation spalling

The invention claimed is:

1. A ferritic stainless steel comprising:
C at 0.015 mass % or less;
Si at 0.4 to 1.0 mass %;
Mn at 1.0 mass % or less;
P at 0.040 mass % or less;
S at 0.010 mass % or less;
Cr at 16 to 23 mass %;
Al at 0.2 to 1.0 mass %;
N at 0.015 mass % or less;
Cu at 1.0 to 2.5 mass %;
Nb at 0.3 to 0.65 mass %;
Ti at 0.5 mass % or less;
Mo at 0.1 mass % or less; and
W at 0.1 mass % or less, the Si and the Al satisfying a relation Si (mass %) Al (mass %); and
Fe and unavoidable impurities as the balance.

2. The ferritic stainless steel according to claim 1, further comprising one or two or more selected from the group consisting of B at 0.003 mass % or less, REM at 0.08 mass % or less, Zr at 0.50 mass % or less, V at 0.5 mass % or less, Co at 0.5 mass % or less, and Ni at 0.5 mass % or less.

3. The ferritic stainless steel according to claim 1, wherein Ti exceeds 0.15 mass %, but is not higher than 0.5 mass %.

4. The ferritic stainless steel according to claim 1, wherein Ti is 0.01 mass % or less.

5. The ferritic stainless steel according to claim 2, wherein V is 0.01 to 0.5 mass %.

6. The ferritic stainless steel according to claim 1, further comprising Co at 0.5 mass % or less.

7. The ferritic stainless steel according to claim 3, wherein V is 0.01 to 0.5 mass %.

8. The ferritic stainless steel according to claim 2, wherein Ti exceeds 0.15 mass %, but is not higher than 0.5 mass %.

9. The ferritic stainless steel according to claim 2, wherein Ti is 0.01 mass % or less.

10. The ferritic stainless steel according to claim 8, wherein V is 0.01 to 0.5 mass %.

* * * * *